United States Patent [19]

Saijo et al.

[11] Patent Number: 4,982,770

[45] Date of Patent: Jan. 8, 1991

[54] APPARATUS FOR FILLING SPECIFIED AMOUNT OF LIQUID

[75] Inventors: Yoshihiro Saijo; Takashi Arao; Yoshitaka Yamane, all of Tokushima, Japan

[73] Assignee: Shikoku Kokoki Co., Ltd., Tokushima, Japan

[21] Appl. No.: 477,143

[22] Filed: Feb. 8, 1990

Related U.S. Application Data

[63] Continuation of Ser. No. 230,539, Aug. 10, 1988, abandoned.

[30] Foreign Application Priority Data

Aug. 13, 1987 [JP] Japan ..... 62-202258
Aug. 13, 1987 [JP] Japan ..... 62-202259
Aug. 13, 1987 [JP] Japan ..... 62-202260

[51] Int. Cl.[5] ..... B67C 3/20; B67D 3/00

[52] U.S. Cl. ..... 141/258; 141/260; 222/510

[58] Field of Search ..... 222/409, 502, 503, 510; 141/258, 259, 260, 261, 262, 116

[56] References Cited

U.S. PATENT DOCUMENTS

| | | | |
|---|---|---|---|
| 621,612 | 3/1899 | Mattingly | 141/261 |
| 1,106,885 | 8/1914 | Miller | 222/502 |
| 1,201,409 | 10/1916 | Whitsett | 222/510 |
| 1,945,065 | 1/1934 | Mösslang et al. | 222/502 |
| 2,103,817 | 3/1936 | Johnson | 141/116 |
| 2,482,593 | 9/1949 | Palmer | 222/503 |
| 2,597,943 | 5/1952 | Meyer | 141/286 |
| 2,723,058 | 11/1955 | Gardes | 222/503 |
| 3,072,295 | 1/1963 | Lovette | 222/503 |
| 3,501,030 | 3/1970 | Flink | 222/503 |
| 3,626,997 | 12/1971 | Whitaker | 141/258 |
| 4,230,160 | 10/1980 | Buckley | 141/116 |
| 4,925,069 | 5/1990 | Ueda et al. | 141/258 |

FOREIGN PATENT DOCUMENTS

| | | | |
|---|---|---|---|
| 0138234 | 1/1984 | European Pat. Off. | 141/115 |

*Primary Examiner*—Henry J. Recla
*Assistant Examiner*—Keith Kupferschmid
*Attorney, Agent, or Firm*—Armstrong, Nikaido, Marmelstein, Kubovcik & Murray

[57] ABSTRACT

An apparatus for filling a specified amount of liquid comprising a metering cylinder having a piston therein, a vertical filling nozzle having an open lower end and feedable with a liquid from the metering cylinder by the operation of the piston, a damper for opening and closing the open lower end of the filling nozzle, a spring biasing the damper to hold the nozzle end closed with the damper while the feed of the liquid is discontinued, and an opening portion adapted to open the damper against the spring simultaneously with or immediately before the start of feed of the liquid with the damper closed and to be subsequently brought out of operative relation with the damper before the feed of the liquid is discontinued so as to render the damper closable by the spring.

10 Claims, 8 Drawing Sheets

APPARATUS FOR FILLING SPECIFIED AMOUNT OF LIQUID

This application is a continuation of application Ser. No. 230,539 filed Aug. 10, 1988 abandoned.

BACKGROUND OF THE INVENTION

1. Field of the Invention

The present invention relates to an apparatus for filling containers each with a specified amount of liquid such as flowable food.

2. Description of the Prior Art

Examined Japanese Patent Publication No. 26550/1984, for example, discloses such an apparatus which comprises a tubular nozzle body, a damper attached to the lower end of the nozzle body and movable upward and downward, a spring suspending member fixedly disposed in an upper portion of the nozzle body, a coiled spring suspended from the suspending member, a member connecting the lower end of the spring to the free end of the damper, and a resistance member fixed to the connecting member and positioned below the coiled spring for offering resistance to a liquid flowing down.

When the liquid is forcibly charged into the apparatus, the pressure of the liquid acting on the damper opens the damper against the force of the spring. The liquid pressure acting on the resistance member adds to the damper opening force, opening the damper to a greater extent and consequently permitting the nozzle body to discharge the liquid more rapidly. The rapid flow of the liquid precludes occurrence of air bubbles due to stirring of the liquid to assure a high-speed filling operation.

Notwithstanding the above advantage, the conventional apparatus has the following problem.

The spring force, if increased, makes the damper difficult to open, whereas a lower spring force renders the damper difficult to close. It is therefore difficult to adjust the spring force. Especially when the liquid to be filled contains a fibrous substance, fibers become lodged in the pivoted portion of the damper, making the damper no longer openable or closable smoothly.

SUMMARY OF THE INVENTION

The main object of the present invention is to provide an apparatus for filling a specified amount of liquid into containers free of the above problem.

The liquid filling apparatus of the present invention comprises a metering cylinder having a piston therein, a vertical filling nozzle having an open lower end and feedable with a liquid from the metering cylinder by the operation of the piston, a damper for opening and closing the open lower end of the filling nozzle, a spring biasing the damper to hold the nozzle end closed with the damper while the feed of the liquid is discontinued, and opening means adapted to open the damper against the spring simultaneously with or immediately before the start of feed of the liquid with the damper closed and to be subsequently brought out of operative relation with the damper before the feed of the liquid is discontinued so as to render the damper closable by the spring.

With the present invention, the damper is forcibly opened by the opening means against the spring, and the force of the spring is set to such a magnitude that the damper can be closed properly. The damper can therefore be opened and closed with good stability.

DESCRIPTION OF THE PREFERRED EMBODIMENTS

Embodiments of the invention will be described below with reference to the drawings.

Figure 1:
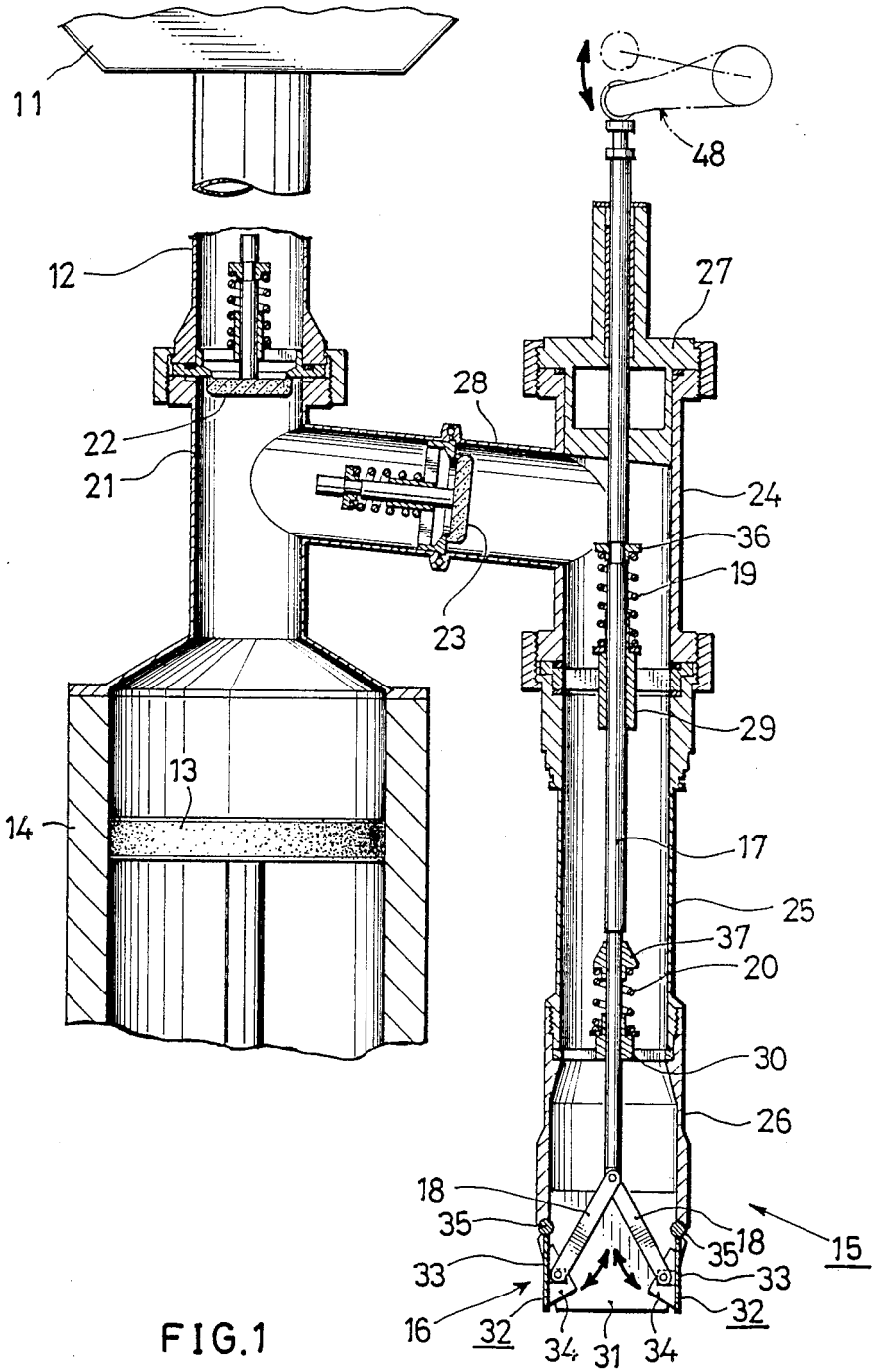
FIG. 1 is a view partly in vertical section and showing a first embodiment of the invention.

FIG. 1 shows a liquid filling apparatus which comprises a tank 11 for containing the liquid to be filled, a metering cylinder 14 connected to the bottom of the tank 11 by a connecting pipe 12 and having a piston 13 therein, a vertical tubular nozzle 15 connected to the metering cylinder 14, a damper 16 attached to the lower end of the filling nozzle 15 and pivotally movable upward and downward, a vertical rod 17 held by the filling nozzle 15 vertically movable, a member 18 connecting the free end of the damper 16 to the lower end of the vertical rod 17, and upper and lower coiled compression springs 19, 20 biasing the vertical rod 17 upward.

The metering cylinder 14 has a T-shaped liquid conduit 21 having two open ends, one of which is provided with an inlet check valve 22 and the other with an outlet check valve 23. The filling nozzle 15 comprises an upper member 24, an intermediate member 25 and a lower member 26. The upper member 24 has a closure 27 covering its upper end and an inlet pipe portion 28 at the middle of its height. The pipe portion 28 is connected to the metering cylinder 14. An upper guide member 29 is held between the upper member 24 and the intermediate member 25, and a lower guide member 30 between the intermediate member 25 and the lower member 26. The vertical rod 17 is guided upward and downward by these guide members 29 and 30. The entire upper and intermediate members 24, 25 and the upper portion of the lower member 26 are generally in the form of a hollow cylinder, but the lower portion of the lower member 26 is in the form of a tube with a square cross section. Of the four sides of the square of the open lower end, two opposed sides are provided with a pair of inverted trapezoidal dependent guide plates 31 opposed to each other. The damper 16 is in the form of a double-leafed hinged door and comprises a pair of opening plates 32 provided between the two guide plates 31. Each of the opening plates 32 comprises a rectangular bottom plate 33, and triangular side walls 34 extending upright from the respective side edges thereof and slidably in contact with the opposed inner surfaces of the guide plates 31. A horizontal pin 35 secured to the base end of the bottom wall 33 is supported at its opposite ends by the opening edge of the lower member 26. When the opening plates 32 are closed, the bottom walls 33 thereof are combined to form a V-shaped cross section. The vertical rod 17 is fixedly provided with upper and lower retainers 36, 37 above the upper and lower guide members 29, 30, respectively. Upper and lower springs 19, 20 are provided around the vertical rod 17 and disposed between the retainer 36 and the guide member 29, and between the retainer 37 and the guide member 30, respectively. The vertical rod 17 extends upward through the closure 27, with its upper end projecting beyond the closure.

Figure 2:
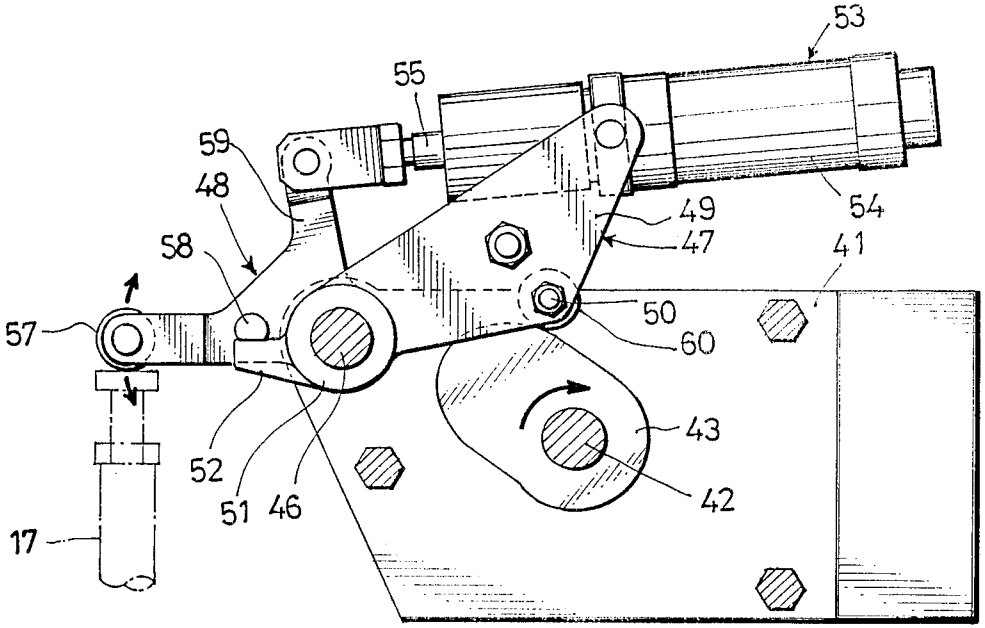
FIG. 2 is a fragmentary front view partly broken away and showing the same.
Figure 3:
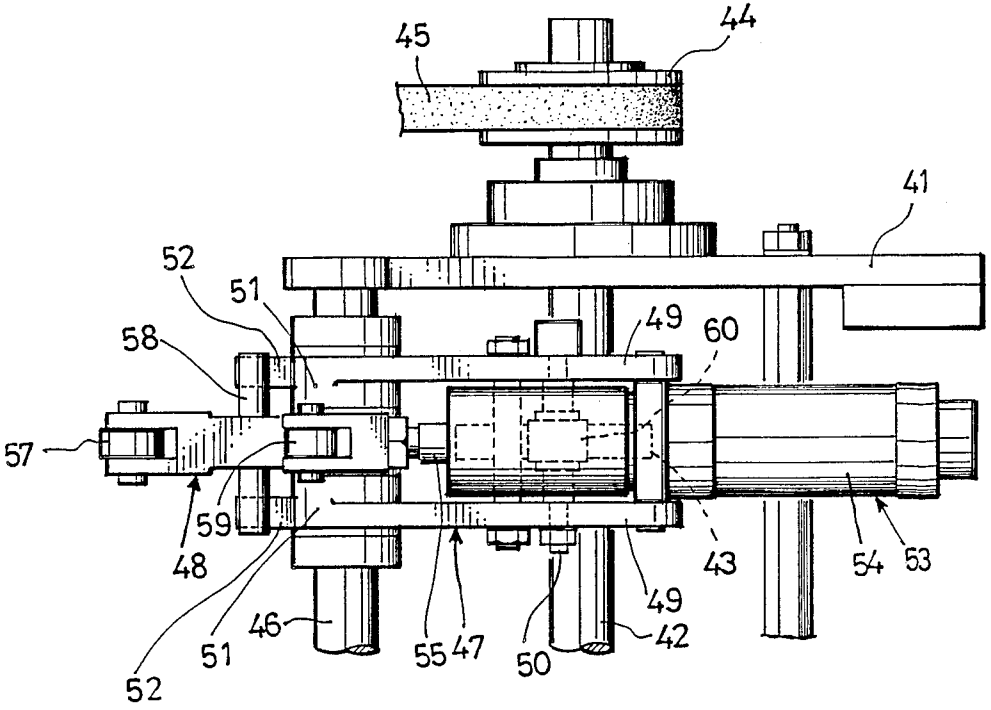
FIG. 3 is a plan view of FIG. 2.
Figure 4:
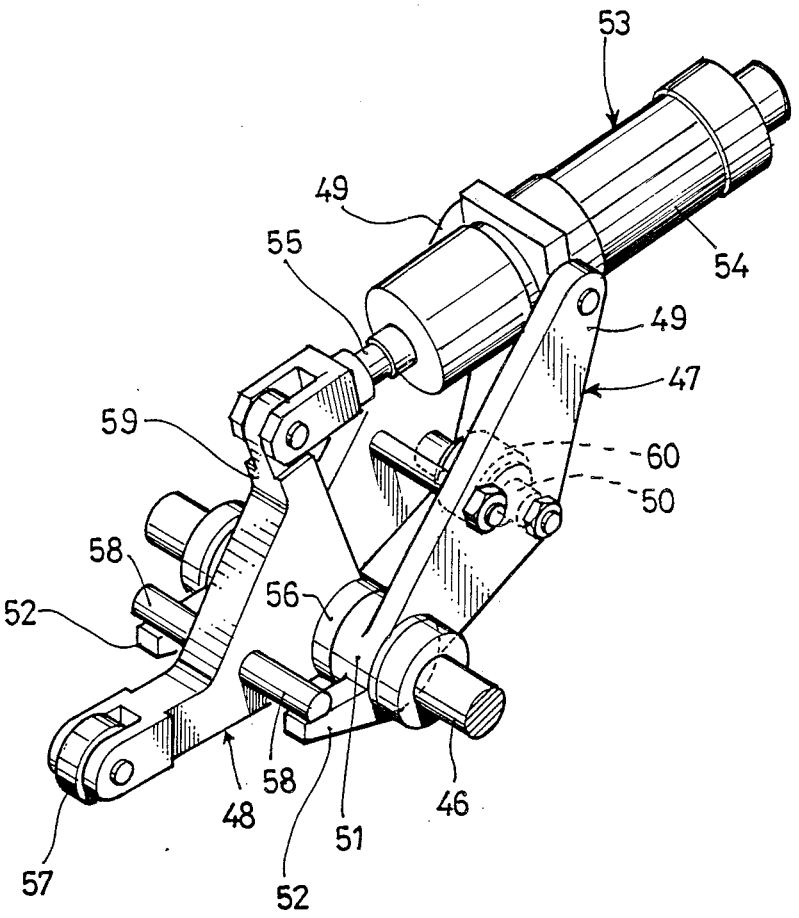
FIG. 4 is a perspective view of the same.

With reference to FIGS. 2 to 4, disposed at the right side of the upwardly projecting end of the vertical rod 17 are a frame 41 and a horizontal drive shaft 42 supported thereon. The drive shaft 42 fixedly carries a plate cam 43 and a pulley 44 having a belt 45 reeved therearound. Although not shown, the belt 45 is driven by the main shaft of a packaging machine, which includes the filling apparatus. A horizontal support arm 46 is disposed between and slightly above the upper end of the vertical rod 17 and the drive shaft 42 and supported by the frame 41 so as to be parallel to the drive shaft 42. A cam follower 47 and a rocker arm 48 are pivotally movably supported by the shaft 46. The cam follower 47 has triangular webs 49 spaced apart from and opposed to each other. A horizontal roller pin 50 carrying a roller 60 thereon extends between and is secured to the webs 49 at their right lower corners. The roller 60 is in contact with the outer periphery of the plate cam 43. Each of the triangular webs 49 has at its left lower corner a boss 51 fitted around the horizontal support shaft 46 and formed with a leftwardly projecting ear 52. A hydraulic cylinder 53 has its body 54 attached to the remaining corner of each triangular web 49, with the piston rod 55 of the cylinder directed leftward. The rocker arm 48 has a boss 56 positioned around the support shaft 46 and between the two bosses 51 of the cam follower 47. The rocker arm 48 fits around the support shaft 46, and extends from the support shaft 46 as illustrated in FIG. 4. The arm 48 carries at its left end a roller 57 in contact with the upper end face of the vertical rod 17. The rocker arm 48 has at a portion thereof close to its base portion horizontal rod-like stoppers 58 projecting from its opposite sides perpendicular thereto and bearing on the respective ears 52 from above. The rocker arm 48 is further formed with an upwardly projecting ear 59 having connected to its top end the piston rod 55 of the hydraulic cylinder 53.

When the hydraulic cylinder 53 is so operated as to advance the piston rod 55, the cam follower 47 and the rocker arm 48 pivotally move together with the stoppers 58 in bearing contact with the leftward projecting ears 52 but are restrained from moving independently of each other. The drive shaft 42, when drivingly rotated in this state, causes the plate cam 43 to pivotally move the cam follower 47 along with the rocker arm 48. The vertical rod 17 is pushed down by the rocker arm 48 thus moved and is pushed up by the springs 19, 20. Consequently, the rod 17 moves upward and downward to close and open the damper 16.

When the hydraulic cylinder 53 is so operated as to retract the piston rod 55, the rocker arm 48 rotates in a direction in which the stoppers 58 move away from the leftward projecting ears 52. When the rocker arm 48 has rotated through a specified angle, the roller 57 on the left end of the rocker arm 48 is located above its position shown in FIG. 2, as spaced from the vertical rod 17 by a distance greater than the distance of movement of the roller 57 by the cam 43. Accordingly, the cam follower 47 and the rocker arm 48 are pivotally movable by the plate cam 43 without vertically moving the rod 17 and therefore without opening or closing the damper 16. Consequently the filling operation can be interrupted even when the drive shaft 42 is driven at all times by the pulley 44 having the belt 45.

The time when the damper 16 is to be opened and the degree of opening thereof can be varied by altering the shape of the contour of the cam 43 for use with liquids of different properties.

Figure 5:
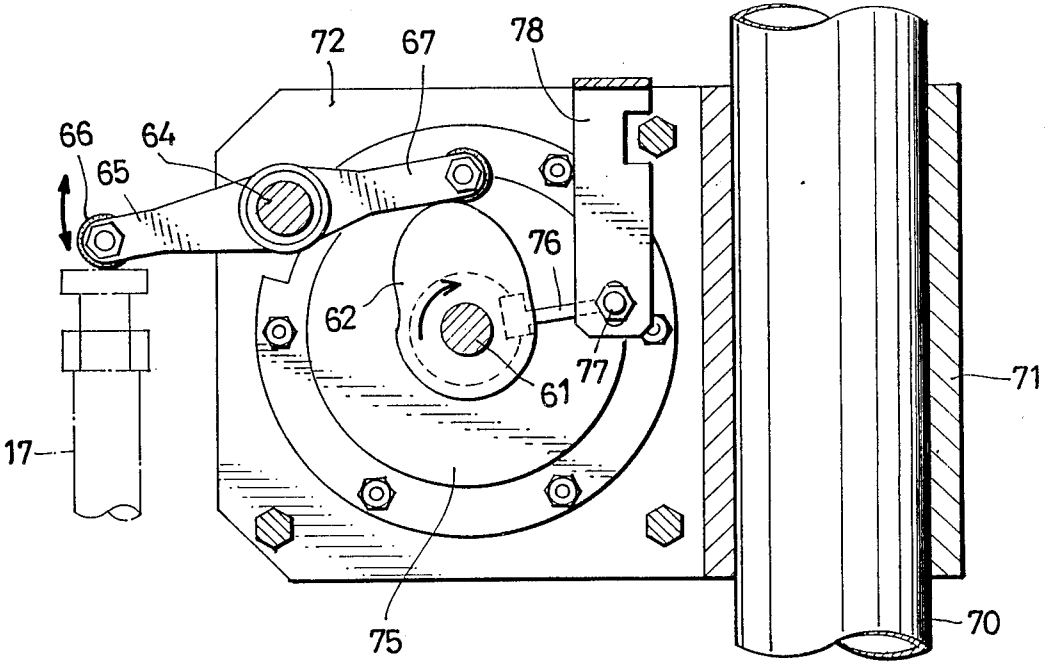
FIG. 5 is a front view corresponding to FIG. 2 and showing a second embodiment of the invention.
Figure 6:
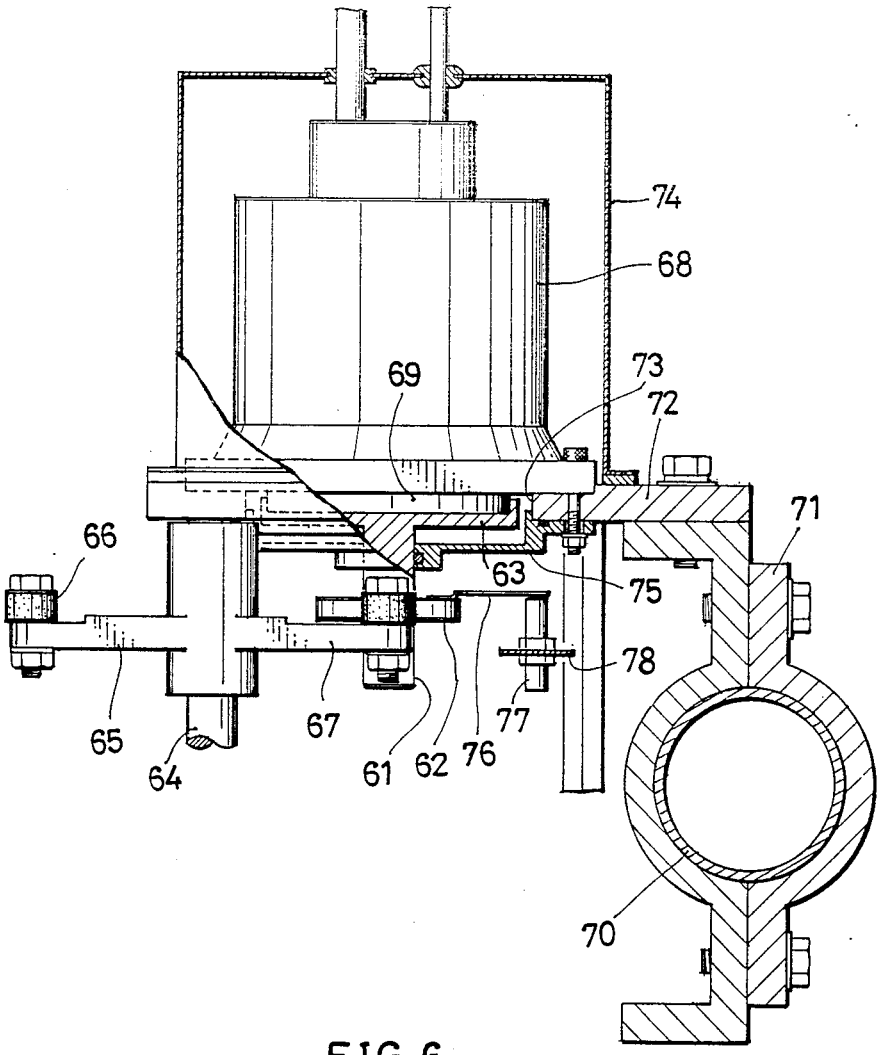
FIG. 6 is a plan view corresponding to FIG. 3 and showing the same.

Another embodiment of means for pivotally moving the rocker arm will be described with reference to FIGS. 5 and 6.

A horizontal rotary shaft 61 is disposed at the right side of the upwardly projecting end of the vertical rod 17. The rotary shaft 61 is fixedly provided with a plate cam 62 approximately at its midportion and has a flange 63 at one end thereof. A horizontal support shaft 64 is disposed between and slightly above the upper end of the vertical rod 17 and the rotary shaft 61 so as to extend in parallel to the shaft 61. A rocker arm 65 is pivotally movably supported by the support shaft 64 and carries at its free end a roller 66 in bearing contact with the upper end of the vertical rod 17. A cam follower 67 is integral with the rocker arm 65. A pulse motor 68 has an output shaft 69 connected to the flange 63 of the rotary shaft 61 and is attached to a vertical support plate 72 supported by a bracket 71 on a post 70. The support plate 72 is formed with an aperture 73 having the output shaft 69 inserted therein. Covers 74 and 75 are attached to the respective sides of the support plate 72 for covering the pulse motor 68. The plate cam 62 has attached thereto a pointer 76 extending outward from the center of its rotation radially thereof. A proximity sensor 77 for detecting the pointer 76 is mounted on the support plate 72 by a bracket 78.

When the output shaft 69 is rotated by operating the pulse motor 68, the cam follower 67 is pivotally moved with the rocker arm 65 by the plate 62, vertically moving the rod 17 to open and close the damper 16 as already described.

Since the speed and angle of rotation of the pulse motor 68 are adjustable, the degree of opening of the damper 16 is easily adjustable, for example, according to the viscosity of the liquid to be filled. This renders the apparatus usable for liquids of different properties.

Figure 7:
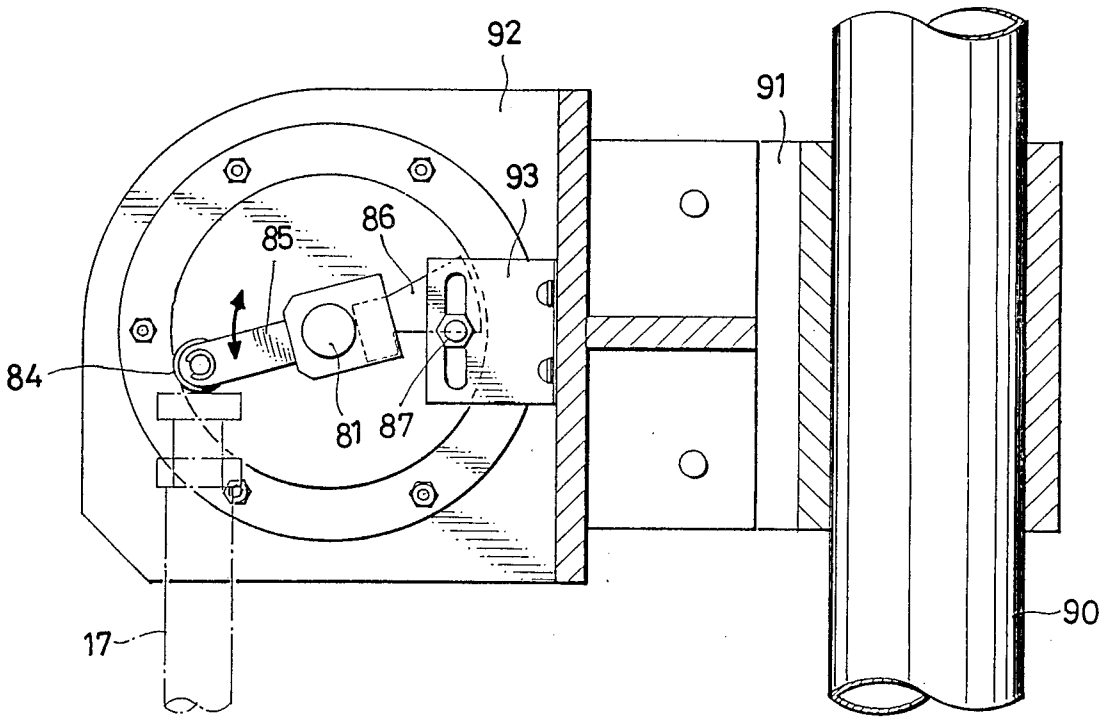
FIG. 7 is a front view corresponding to FIG. 2 and showing a third embodiment.
Figure 8:
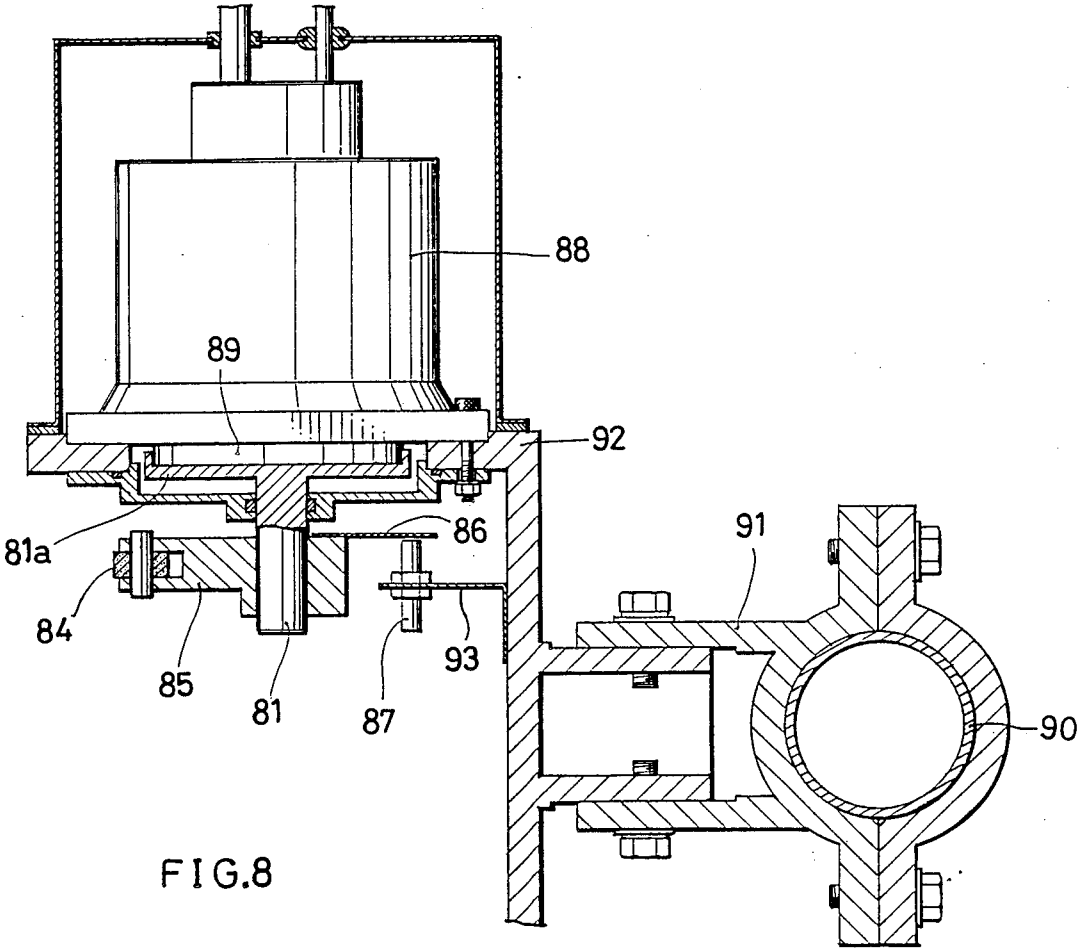
FIG. 8 is a plan view corresponding to FIG. 3 and showing the same.

Still another embodiment of means for pivotally moving the rocker arm will be described with reference to FIGS. 7 and 8.

A horizontal rotary shaft 81 is disposed at the right side of the upper end of the vertical rod 17, and a rocker arm 85 is secured at its base portion to the shaft 81. The rocker arm 85 carries at its forward end a roller 84 in contact with the upper end face of the vertical rod 17. The rotary shaft 81 is provided at its one end with a flange **81*a* connected to the output shaft 89 of a pulse motor 88. Like the pulse motor 68, the pulse motor 88 is attached to a vertical support plate 92 supported by a bracket 91 on a post 90. The rocker arm 85 has attached thereto a sectorial plate 86 extending outward from the center of its rotation radially thereof. A proximity sensor 87 for detecting the plate 86 is attached to the support plate 92 by a bracket 93**.

When the output shaft 89 is rotated forward and reversely by operating the pulse motor 88, the rocker arm 85 is rocked, thereby moving the vertical rod 17 upward and downward to close and open the damper 16 in the same manner as already described.

While the invention has been particularly shown and described in reference to preferred embodiments thereof, it will be understood by those skilled in the art that changes in form and details may be made therein without departing from the spirit and scope of the invention.

What is claimed is:

1. A liquid filling apparatus comprising:

a metering means for feeing a predetermined amount of liquid, the metering means having, (a) a metering cylinder having a piston therein, (b) a filling nozzle for receiving predetermined amount of liquid from the metering cylinder by the operation of the piston, the filling nozzle having an open lower end, (c) a damper means provided at the open lower end of the filling nozzle for opening and closing the same, (d) a movable vertical rod positioned within said filling nozzle and directly attached to the damper at one end thereof, the other end of the movable rod extending outside of the filling nozzle and of the metering means, the movable vertical rod being capable to take an upward position to close the damper and a downward position to open the same, (e) a spring means positioned between the filling nozzle and the movable rod for biasing the movable rod in order to close the open lower end; and a rocker arm means positioned at the outside of the metering means and in the vicinity of the other end of the movable rod and for driving the movable rod solely to open the damper, the rocker arm means being independent of the movable vertical rod and having a rocker arm and a driving means for intermittently driving the rocker arm in a manner such that the rocker arm is capable to take a first position to drive the movable vertical rod to take the downward position to open the damper means only when the liquid within the filling nozzle is to be released and to take a second position away from the movable rod to allow the movable rod to return to the upward position solely by the action of the spring means to close the damper means.

2. An apparatus as defined in claim 1, wherein the filling nozzle is provided at an intermediate portion between an upper end and the lower end thereof with an inlet for receiving therethrough the liquid from the metering cylinder, the damper means being movable upward and downward, the movable rod being movably held in the filling nozzle in the upward and downward direction and having an upper end of the movable rod extending through an upper end of the filling nozzle and projecting thereabove, the damper means having a free end being connected by a connector to the lower end of the movable vertical rod, the rocker arm having a forward end in a detachable contact with an upper and face of the movable rod.

3. An apparatus as defined in claim 2, wherein the rocker arm is mounted on a horizontal support shaft supported by a frame of the apparatus, and the driving means comprises a horizontal drive shaft extending in parallel to the horizontal support shaft and supported by the frame of the apparatus, a cam secured to the horizontal drive shaft, a cam follower mounted on the support shaft pivotally movably, and a transmitting means for restraining the cam follower and the rocker arm so as to transmit the pivotal movement of the cam follower to the rocker arm and for moving the rocker arm between an operative position wherein the pivotal movement of the rocker arm can be transmitted to the movable vertical rod with the follower and the rocker arm restrained, and an inoperative position, incapable of the transmission.

4. An apparatus as defined in claim 3, wherein the transmitting means is a hydraulic cylinder having a piston rod connected to the rocker arm and a body connected to the cam follower.

5. An apparatus as defined in claim 2, wherein the rocker arm is mounted on a horizontal support shaft supported by a frame of the apparatus, and the driving means comprises a pulse motor supported by the frame of the apparatus and having an output shaft with an axis in parallel with the axis of the horizontal support shaft, a horizontal rotary shaft connected to the output shaft, a cam secured to the rotary shaft, and a cam follower integral with the rocker.

6. An apparatus as defined in claim 2, wherein the driving means comprises a horizontal rotary shaft having a base end of the rocker arm secured thereto, and a pulse motor supported by a frame of the apparatus and having an output shaft connected to the rotary shaft.

7. An apparatus as defined in claim 2, wherein said driving means has a cylinder means operably coupled to the rocker arm for at least one of engaging and disengaging the rocker arm, and a cam means operably coupled to the rocker arm, the rocker arm having a stop means for operably coupling the cam means to the rocker arm.

8. An apparatus as defined in claim 7, wherein said cylinder means is for engaging the rocker arm to the other end of the moveable rod so as to have the rocker arm and the cam means drive the moveable rod in opening the damper means.

9. An apparatus as defined in claim 7, wherein said cylinder means is for disengaging the rocker arm from the other end of the moveable rod so as to preclude the rocker arm and the cam means from driving the moveable rod in opening the damper means.

10. An apparatus as defined in claim 9, wherein said cylinder means is for disengaging the rocker arm from the other end of the moveable rod at a specified distance to permit operation of the cam means along with the rocker arm without having the rocker arm drive the moveable rod.

* * * * *

UNITED STATES PATENT AND TRADEMARK OFFICE

CERTIFICATE OF CORRECTION

PATENT NO. : 4,982,770

DATED : January 8, 1991

INVENTOR(S) : SAIJO et al

It is certified that error appears in the above-identified patent and that said Letters Patent is hereby corrected as shown below:

ON TITLE PAGE: Item [73], "Shikoku Kokoki Co., Ltd." should read --Shikoku Kakoki Co., Ltd.--.

Signed and Sealed this

Eighteenth Day of August, 1992

*Attest:*

DOUGLAS B. COMER

*Attesting Officer*

*Acting Commissioner of Patents and Trademarks*